US005868550A

United States Patent [19]

Howchin

[11] Patent Number: 5,868,550

[45] Date of Patent: Feb. 9, 1999

[54] PUMP ASSEMBLY

[76] Inventor: Robert W. Howchin, 57 James St., Milton, Ontario, Canada, L9T 2P5

[21] Appl. No.: 855,172

[22] Filed: May 13, 1997

[51] Int. Cl.[6] ..... F04D 9/00; F04D 9/06

[52] U.S. Cl. ..... 415/1; 415/24; 415/26; 415/56.5; 417/199.1; 417/435

[58] Field of Search ..... 415/1, 24, 26, 415/29, 47, 49, 56.1, 56.5, 211.2, 212.1; 417/199.1, 200, 435

[56] References Cited

U.S. PATENT DOCUMENTS

| | | | |
|---|---|---|---|
| 1,430,611 | 10/1922 | Antonsanti | 415/1 |
| 2,019,143 | 10/1935 | La Bour | 415/56.1 |
| 2,510,190 | 6/1950 | Nicolette | 415/24 |
| 2,831,434 | 4/1958 | Paashaus | 415/56.1 |
| 3,048,117 | 8/1962 | Franzen et al. | 415/211.2 |
| 4,780,050 | 10/1988 | Caine . | |
| 4,934,914 | 6/1990 | Kobayashi . | |
| 5,356,274 | 10/1994 | Lee . | |

FOREIGN PATENT DOCUMENTS

| | | | |
|---|---|---|---|
| 297390 | 4/1917 | Germany | 415/56.5 |
| 27746 | 11/1909 | Sweden | 415/56.1 |

OTHER PUBLICATIONS

Monarch Industries Owner's, Manual, "Self Priming Shallow Well Jet Pumps", Jun., 1995.

"Water Pump Aid the Prime of Your Life", faxed Oct. 16, 1996 by American Water Works.

Max's Amazing Easy Prime, pp. 127–128, no date.

Penberthy Jet Pump Technical Data, "Pumping Liquids", issued May, 1987.

*Primary Examiner*—Christopher Verdier

[57] ABSTRACT

A pump assembly, comprising a pump with a chamber having a vacuum region therein, a priming fluid reservoir, a suction line for fluid communication between the vacuum region and a fluid source, and a priming suction line for fluid communication between the vacuum region and the priming fluid reservoir, in order to deliver priming fluids to the vacuum region so as to establish a primed condition in the pump; a suction flow control in the suction line and a priming flow control in the priming suction line; the flow controls being operable to restrict flow through the suction line and the priming suction line, in order to establish a vacuum in the vacuum region to substantially fill the suction line with fluid from the source while maintaining the primed condition, wherein the vacuum is variable up to a maximum suction capacity of the pump.

20 Claims, 7 Drawing Sheets

PUMP ASSEMBLY 10

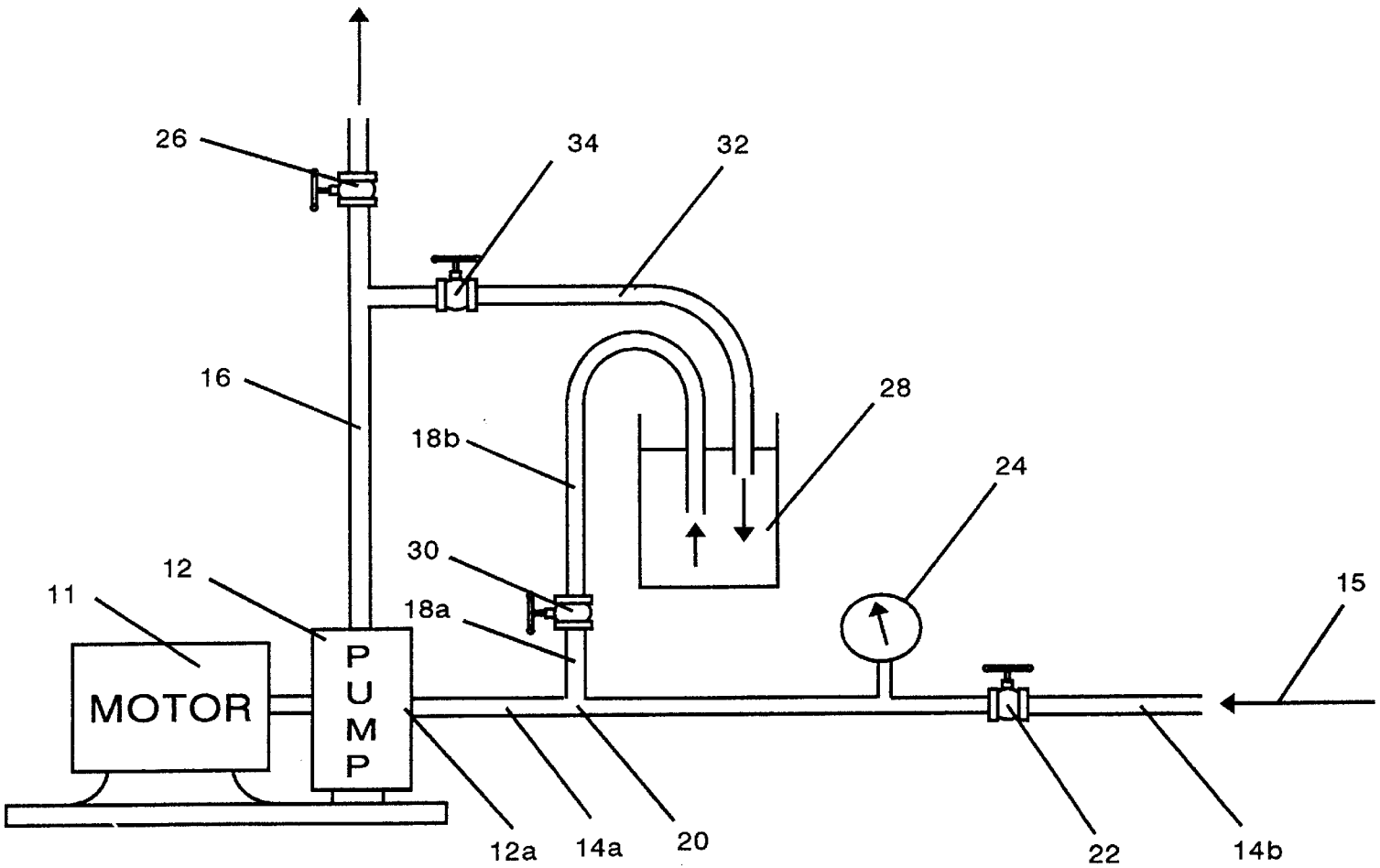
FIGURE 1 – PUMP ASSEMBLY 10

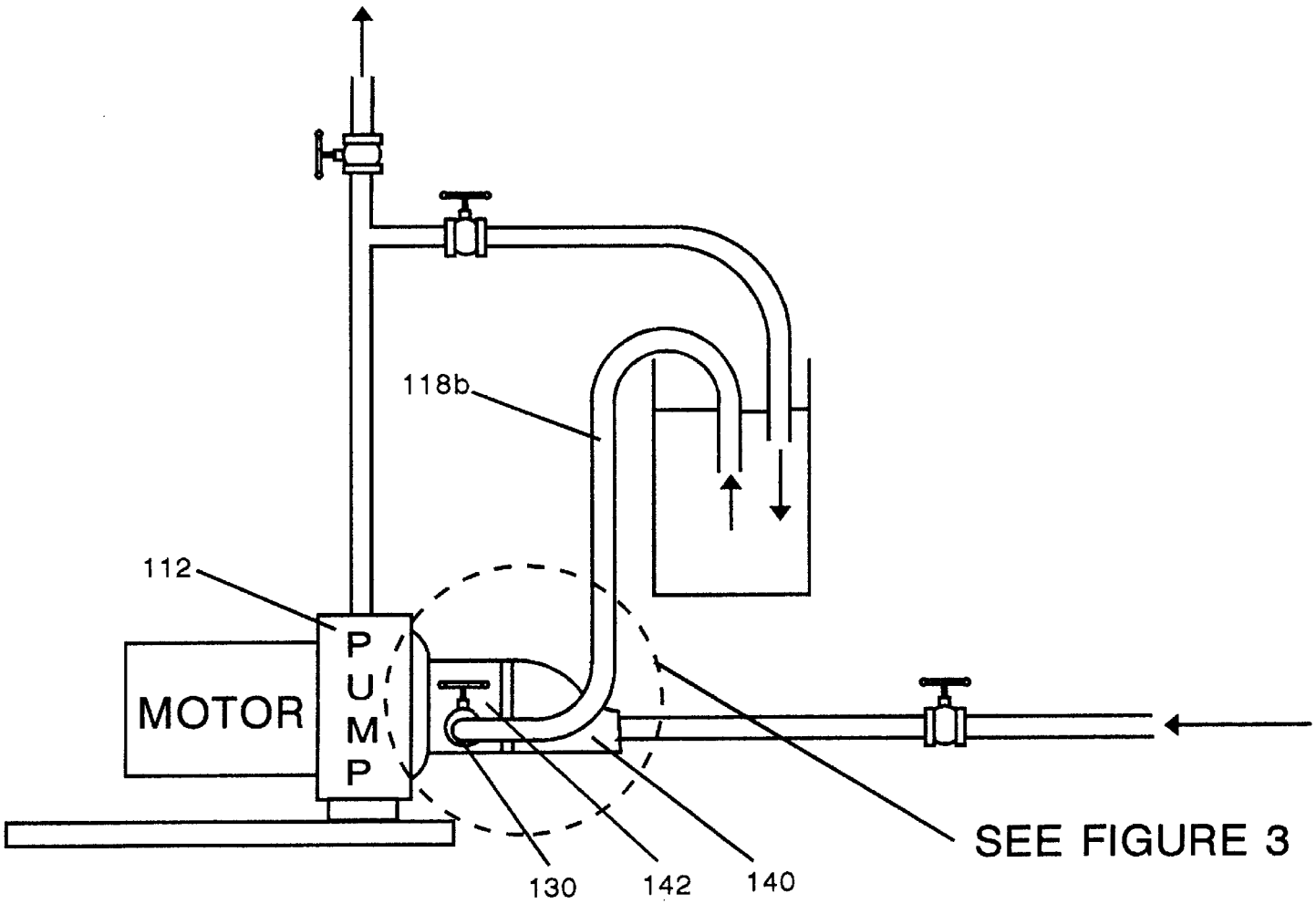
FIGURE 2 – PUMP ASSEMBLY 110

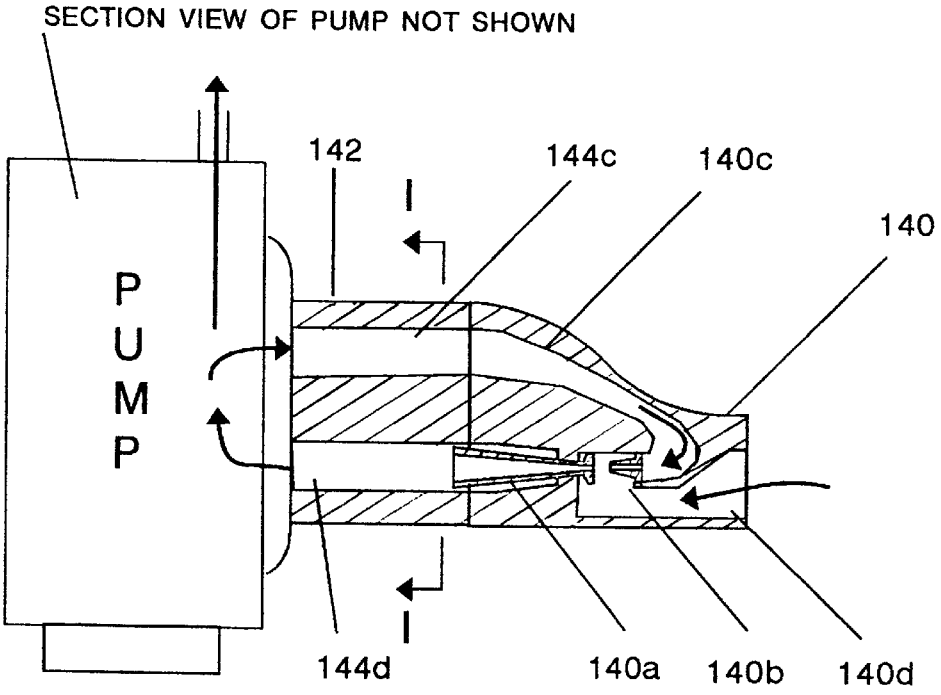
FIGURE 3 - SECTION THROUGH EJECTOR PUMP 140 AND EXTENSION MEMBER 142
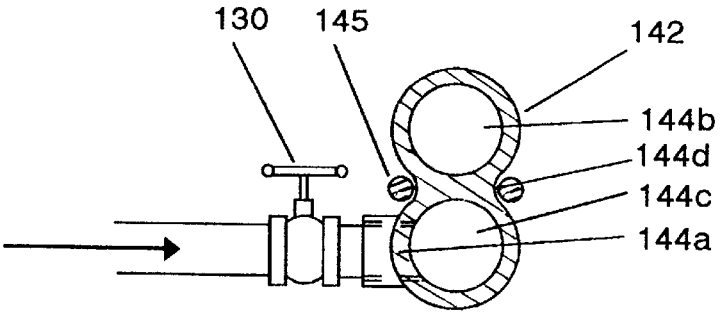
FIGURE 4 - SECTION I-I

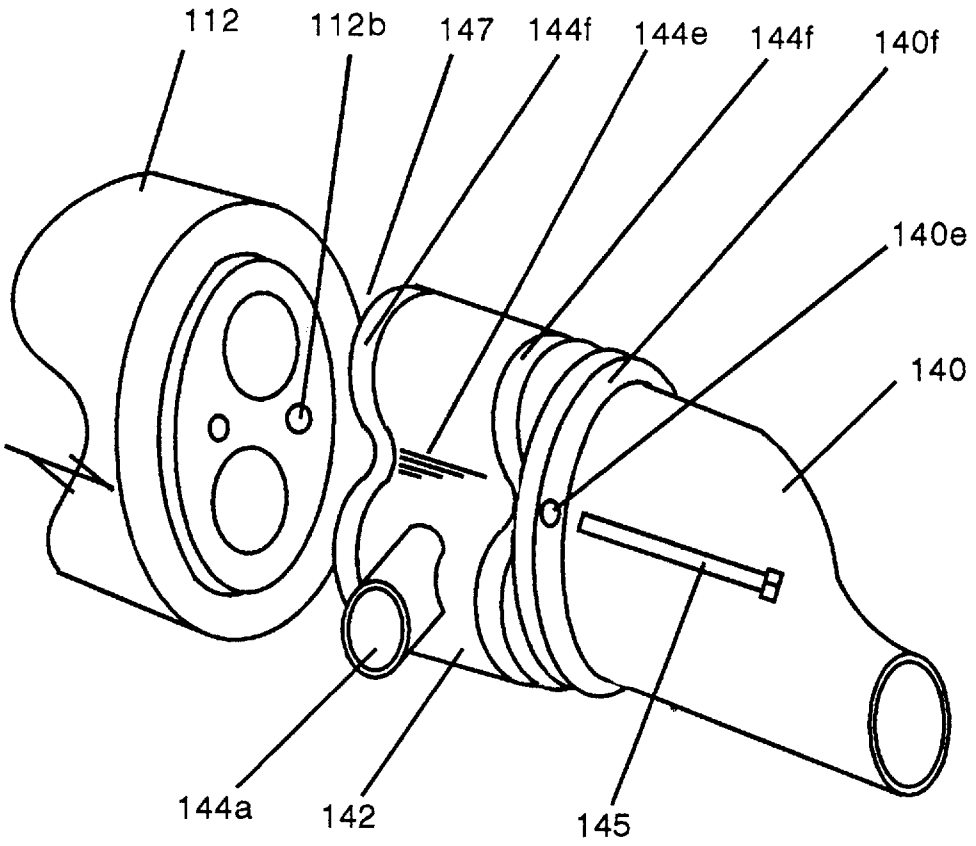
FIGURE 3A – EXTENSION MEMBER

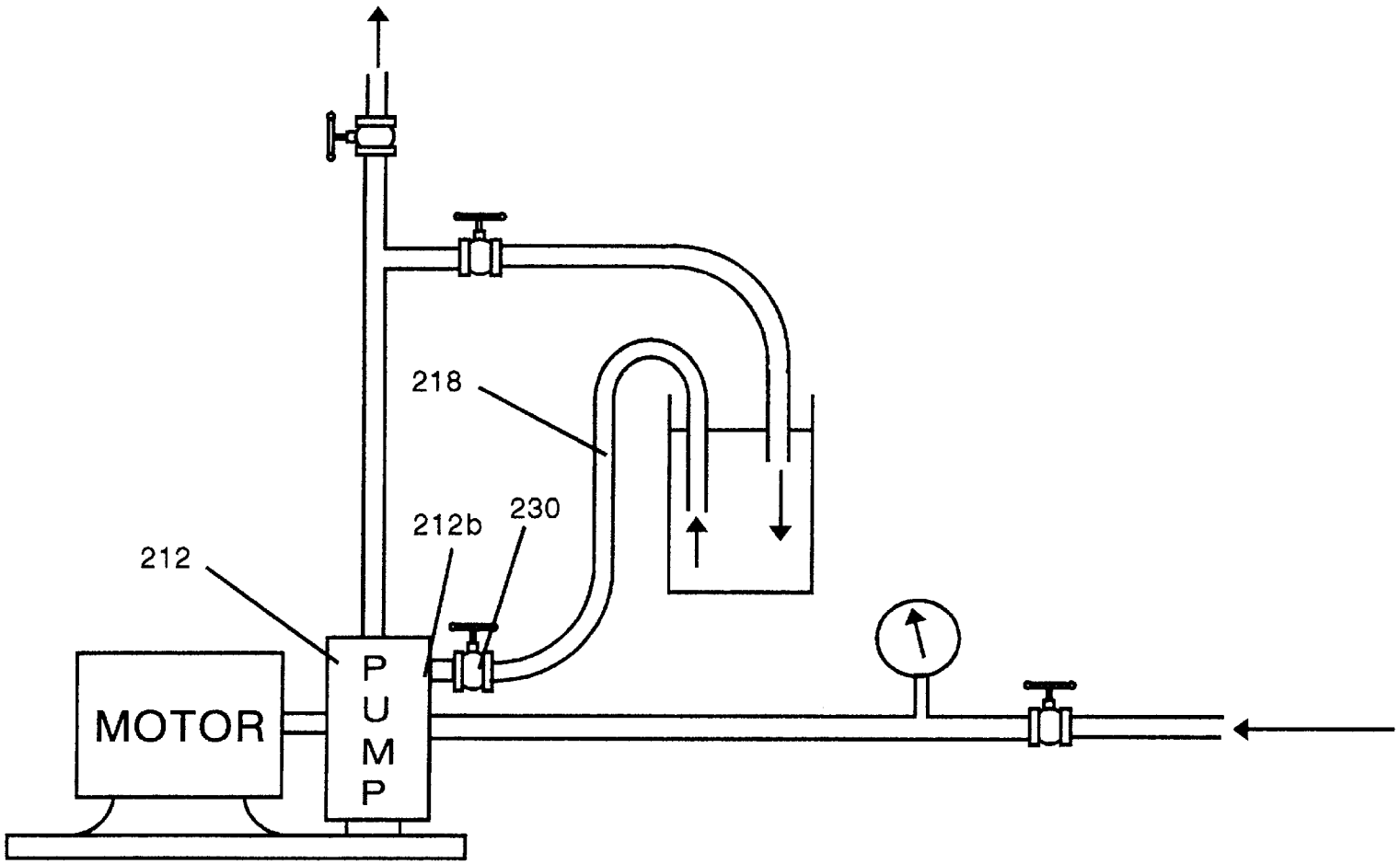
FIGURE 5 — PUMP ASSEMBLY 210

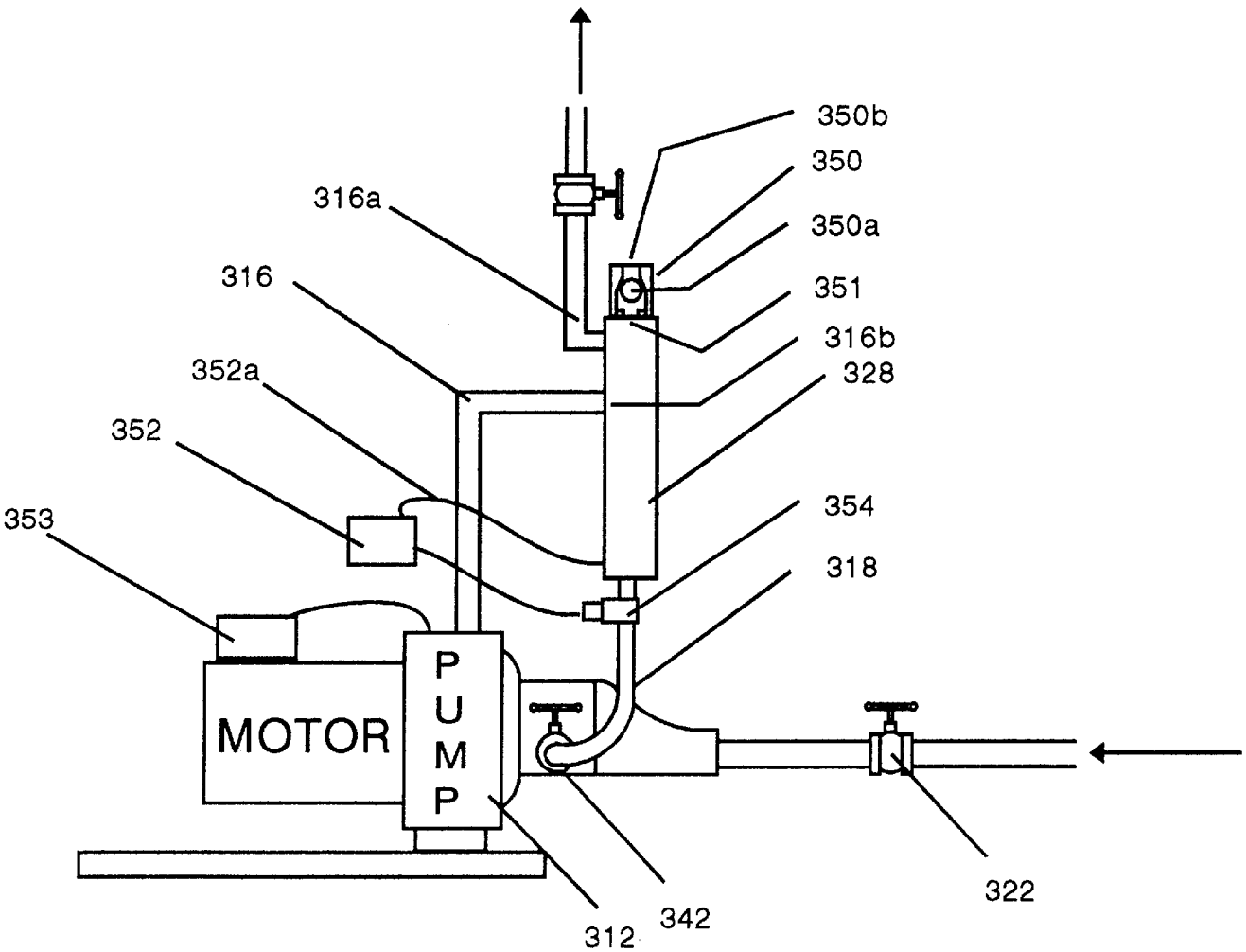
FIGURE 6 — PUMP ASSEMBLY 310

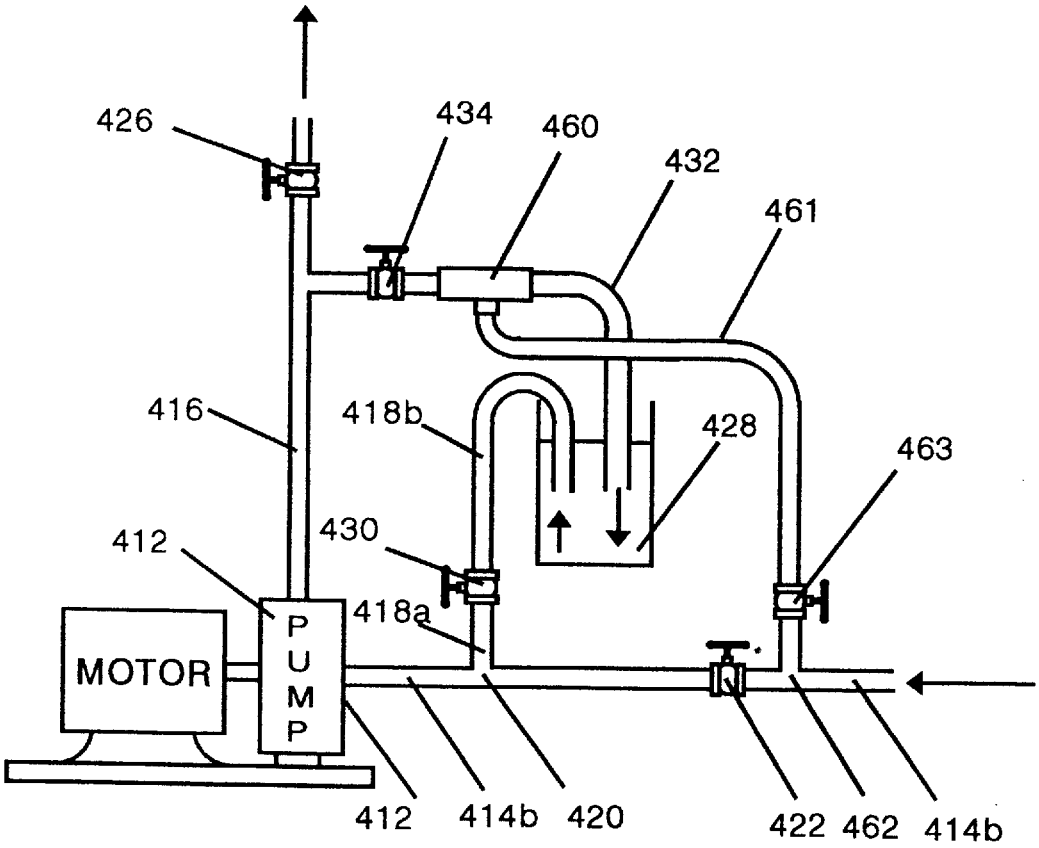
FIGURE 7 — PUMP ASSEMBLY 410
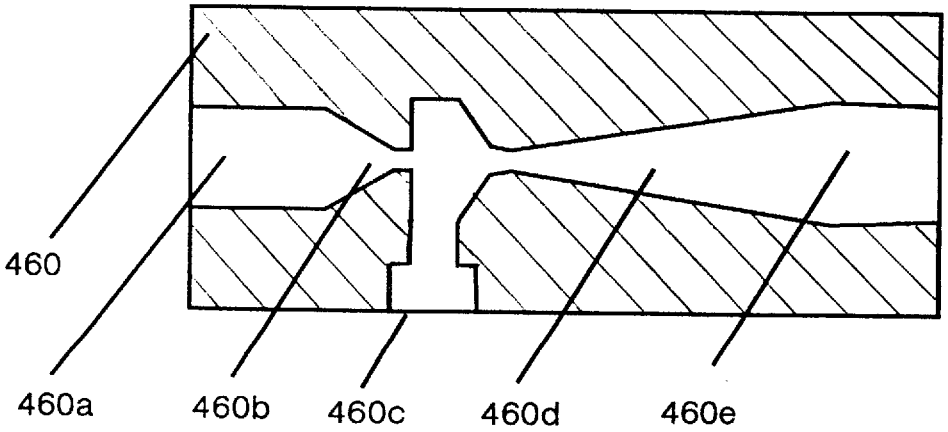
FIGURE 8 — SECTION THROUGH EJECTOR PUMP 460

PUMP ASSEMBLY

BACKGROUND OF THE INVENTION

1. Field of the Invention

The present invention relates to pumps and more particularly to the priming of residential and industrial pumps.

2. Description of the Related Art

One of the rituals of cottage life in North America is priming the water pump in the spring. This usually involves lugging many pails full of water up to the cottage from the lake or the well. The water is then poured down the priming hole of the pump, usually spilling everywhere, in an attempt to fill the suction line and pump with water to remove the air from the system, and thereby to prime the pump. The process can be very difficult, particularly with long suction lines running over irregular ground that are prone to trapping air in high spots in the line and this often results in many hours of priming time.

There are several known methods to prime cottage pumps such as using hand or electric pumps to fill the suction line with water at the foot valve, and hand pumps attached to the pump to pull water up the suction line by creating a vacuum in the pump. With any of these systems, however, air can still remain trapped in the high spots in the line and there is no way to tell if priming is complete and the process may still need to be repeated several times.

The priming of industrial pumps is often accomplished by using powered vacuum pumps to suck water up the line, using ejector pumps installed downstream of the pump that are driven by compressed air or another source of water to create a vacuum sucking water up through the pump, and using auxiliary submersible priming pumps to fill the lines and prime the pump.

There are several so-called 'self-priming' water pumps currently available for cottages and farms. However, it is still necessary for the operator, in some cases, to fill the suction line with water and it is often necessary to add more water to the pump during the priming cycle. Moreover, these so-called 'self-priming' pumps are not intended to improve the priming operation of the many thousands of conventional pumps already in use.

U.S. Pat. No. 5,356,274 entitled SUPPLYING SELF SUCTION UNIT describes a self priming pump system. In this arrangement, storage tanks are required on the suction and discharge sides of the pump. These tanks are required to retain priming fluid at all times to prime the system but the size of the tanks required to hold sufficient priming fluid to prime the system in the event of a loss of prime and withstand the operating pressures of the systems would make them an expensive solution for cottage or farm installations.

U.S. Pat. No. 4,780,050 entitled SELF PRIMING PUMP SYSTEM describes a system to self-prime pumps and in particular, aircraft fuel pumps. The system has a priming reservoir above the pump with a bypass line from the reservoir tank to the pump to wet the impeller so that the pump can operate at all times and retain its prime using fluid from the reservoir. While this system will generate a partial vacuum to prime the fuel pump effectively, no provision is made to accommodate high lifts typical on cottage water systems or many industrial applications.

U.S. Pat. No. 4,934,914 entitled PORTABLE MOTOR PUMP describes a pump to drain residual water from a ground-level source, such as a puddle on a street, and to accommodate air accompanying the residual water. The pump has a self priming feature by way of a pump which is located within an outer casing full of water to maintain a flooded condition at the impeller, similar to a conventional submersible pump. As in the case of the fluid pump mentioned above, no provision is made to remove air and, at the same time, to generate sufficiently high vacuums capable of very high lifts, such as for example over 20 feet.

These aforementioned pump arrangements and other residential pump systems have difficult, expensive, or inadequate priming methods for very high lifts. They often require the suction line to be initially filled with water, are physically demanding, or are cumbersome in the set up to prime the pump. Some pump arrangements may also require external sources of power such as compressed air or water flow to prime the system.

It is an object of the present invention to obviate these difficulties.

SUMMARY OF THE INVENTION

Briefly stated, the invention involves a pump assembly, comprising:

a pump with a chamber having a vacuum region therein, a priming fluid reservoir, a suction line for fluid communication between the vacuum region and a fluid source, and a priming suction line for fluid communication between the vacuum region and the priming fluid reservoir, in order to deliver priming fluids to the vacuum region so as to establish a primed condition in the pump;

suction flow control means in the suction line and priming flow control means in the priming suction line;

the flow control means being operable to restrict flow through the suction line and the priming suction line, in order to establish a vacuum in the vacuum region to substantially fill the suction line with fluid from the source while maintaining the primed condition, wherein the vacuum is variable up to a maximum suction capacity of the pump.

In another aspect of the present invention, there is provided a method of priming a pump assembly, comprising the steps of:

providing a pump with a vacuum region therein, providing a suction line in fluid communication between the vacuum region and a fluid source;

providing a priming suction line in fluid communication between the vacuum region and a priming fluid reservoir, in order to deliver priming fluids to the vacuum region so as to establish a primed condition in the pump;

restricting flow through the suction line and the priming suction line, in order to establish a vacuum in the vacuum region, so as to substantially fill the suction line with fluid from the source, while maintaining the primed condition; and varying the vacuum according to the elevation of the pump relative to the fluid source, up to a maximum suction capacity of the pump.

In still another aspect of the present invention, there is provided a kit for priming a pump of a type having a chamber with a vacuum region, a suction line in fluid communication between the vacuum region and a fluid source, and a discharge line in fluid communication with the chamber, comprising:

a suction valve;

a length of pipe operable as a priming suction line, a priming suction valve for fluid communication with the priming suction line, and a sheet of instructions, including the steps of:

i. installing the suction valve in the suction line to control fluid from a fluid source therethrough;

ii. installing the priming suction line so as to be in fluid communication with the vacuum region;

iii. installing one end of the priming suction valve in the priming suction line to control priming fluid flow therethrough; and iv. installing another end of the priming suction line in a priming fluid reservoir.

In still another aspect of the present invention, there is provided a pump assembly, comprising:

a pump with a chamber having a vacuum region therein;

a priming fluid reservoir;

a suction line for fluid communication between the vacuum region and a fluid source;

a priming suction line in fluid communication between the vacuum region and the priming fluid reservoir;

a discharge line in fluid communication with the chamber; and flow control means operable in a first priming position to isolate the vacuum chamber from the suction line, the priming suction line being arranged to deliver sufficient priming fluid to the vacuum chamber when the flow control means is in the first priming position, to establish a primed condition in the pump;

suction means in fluid communication with the discharge line and the suction line and operable when the flow control means is in the priming position to establish a vacuum in the suction line as a result of priming fluid passing through the discharge line.

In yet another aspect of the present invention, there is provided an extension member for use in a fluid pump assembly, the pump of a type having a chamber with a vacuum region therein, an ejector body adjacent the chamber with a suction line passage in fluid communication with the vacuum region and a recirculating passage in fluid communication with the chamber, the extension member comprising a housing defining a first flow passage for fluid communication with the suction line passage, a second flow passage for fluid communication with the recirculating passage, and a priming passage in fluid communication with first flow passage; and mounting means for mounting the housing between the chamber and the ejector body.

BRIEF DESCRIPTION OF THE DRAWINGS

Several preferred embodiments of the present invention will now be described, by way of example only, with reference to the appended drawings in which:

FIG. 1 is a schematic view of a pump assembly;

FIG. 2 is a schematic view of another pump assembly;

FIG. 3 is a magnified view taken on circle 3 of FIG. 2;

FIG. 3*a* is a fragmentary perspective view of one portion of the assembly shown in FIG. 2;

FIG. 4 is a sectional view taken on line A—A of FIG. 3;

FIG. 5 is a schematic view of another pump assembly;

FIG. 6 is a schematic view of still another pump assembly;

FIG. 7 is a schematic view of still another pump assembly; and

FIG. 8 is a sectional view of one portion of the pump shown in FIG. 7.

DESCRIPTION OF THE PREFERRED EMBODIMENTS

Referring to FIG. 1, there is provided a pump assembly 10 having a motor 11, a pump body 12 defining a pump chamber with both an impeller and a vacuum region therein (both not shown). The impeller is a common feature in pumps and the vacuum region is on the upstream (or input) side of the impeller while the downstream (or output) side of the impeller is normally pressurized. The pump body 12 also has a suction port 12*a* which is arranged to receive suction lines 14*a*, 14*b* (which is in turn are connected to a fluid source represented by arrow 15), and discharge line 16, which are in fluid communication with the chamber.

The port 12*a* and the suction line 14*a* are generally sized according to the operating specification of the pump. A pair of priming suction lines 18*a*, 18*b* are provided in fluid communication with the vacuum region, that is through the suction line 14*a* and is joined thereto at a first junction 20. The priming suction lines 18*a*, 18*b* are similar in diameter to the suction lines 14*a*, 14*b* for reasons which will be explained below.

The relative terms 'downstream' and 'upstream' are used below are intended to refer to the direction of fluid flow through the pump assembly during its operation.

A suction flow control means, in the form of a suction valve 22, is located upstream of the first junction for controlling fluid flow through the suction line. A vacuum gauge 24 is also located in the suction line for monitoring the vacuum in the suction line. Discharge flow control means is also provided, in the form of a discharge valve 26, for restricting fluid flow through the discharge line.

A particular feature of the pump assembly 10 is that the priming suction line 18 is arranged to deliver a controlled volume of priming fluid to the chamber to maximize the vacuum generated in the suction lines by the operation of the pump. Furthermore, the flow control means in the suction line has the effect of controlling the quantity of air being drawn into the vacuum region.

Located in the priming suction line is a flow control means, in the form of a priming suction valve 30 for controlling fluid flow through the priming suction line. The flow in the priming suction line is arranged to be above a level sufficient to continuously flood the vacuum region of the chamber (during the priming process) and below a level at which inhibits the maximum vacuum being generated in the suction line.

Also provided is a priming fluid reservoir 28 for supplying priming fluid to the priming suction line 18*b*, a priming discharge line 32, which joins the discharge line between the chamber and the discharge valve 26, for delivering priming fluid from the pump chamber to the reservoir 28, as well as a priming discharge valve 34 for controlling fluid flow through the priming discharge line. A priming discharge line 32 is the same diameter as the priming discharge line specifications of the pump, to provide a normal operational back pressure in the pump during the priming process.

The pump assembly 10 works in the following manner. First, suction and discharge valves 22, 26 are closed. The priming discharge valve 34 is opened fully, the priming suction valve 30 is closed, and the reservoir 28 is filled with water and positioned at a higher elevation than the pump and valve 30, as shown in FIG. 1. Line 18*b* is filled with water and the end of the line is placed in the water in the reservoir 28. The priming suction valve 30 is opened fully and water from the reservoir 28 is siphoned into the pump 12, filling the vacuum region with water. The pump is turned on and priming fluid is pumped through the vacuum region in the pump body 12 and recirculates between the pump and the reservoir 28, through the priming discharge line 32 and the priming suction lines 18*a* and 18*b* and suction line 14*a*.

The priming vacuum is now optimized by slowly closing priming suction valve 30, restricting or controlling fluid flow in the priming suction line 18*a* and increasing the vacuum in suction line 14*a*, until the maximum suction capability of the pump is attained as illustrated on the readout of the vacuum gauge 24. This maximum suction capability is seen when the opening or closing of the valve 30, results in either a reduced vacuum level or a relatively constant vacuum level. The priming system has now been adjusted for the maximum suction available from the pump. For example, if the priming suction valve 30 is closed too far, there will not be sufficient flow of priming fluid to the pump chamber, making it necessary to readjust the priming suction valve 30. Conversely, if the priming suction valve 30 is opened too far, there will be too much flow of priming fluid to the pump chamber and the maximum suction will not be developed in the line 14*a*. It should be recognized that the maximum suction capability of the pump will depend on a number of factors such as the age and fitness, its rated horsepower, volume capacity and the like.

It will be recognized that the vacuum gauge makes the pump assembly relatively straightforward to adjust and to monitor because it gives a visual indication of the level of vacuum in the line. However, the required suction can be also achieved without the vacuum gauge by relying on other characteristics of the system, such as, for example, the ample flow of bubbles in the priming reservoir during the priming process, or manually 'feeling' the continuous vacuum generated at the end of the priming suction line while operating immersed in the reservoir.

When this optimized vacuum level is obtained, providing the maximum suction capability, the suction valve 22 is opened slightly and air will begin to be drawn slowly or in a controlled manner, from the suction line 14*b*.The air will mix with the priming fluid and travel through the pump 12, discharge line 16, priming discharge line 32 and finally be observed as bubbles in the reservoir 28, just before the air is vented to the atmosphere. Too little air removed from the suction line 14*b* will significantly increase the time required to prime the pump. Too much air drawn from the suction line 14*b* during the priming process may collect in the impeller and stop the flow of priming fluid, thereby stopping the priming process. The successful operation of the priming system can be observed and monitored as the air bubbles flow into the reservoir 28.

As air is drawn from suction line 14*b*, the readout of the vacuum gauge will initially drop to zero. As more air is removed from the suction line, the vacuum in the suction line will increase and the readout on the vacuum gauge 24 will increase, until suction line 14*b* completely fills with water, at which time the water level in the reservoir 28 will begin to increase, indicating that priming of pump assembly 10 is almost complete. For suction lines that are difficult to prime, it is advisable to allow the system to run for several minutes to ensure the air is totally purged from the suction line 14*b*.This will be apparent when no more bubbles appear in the reservoir 28 from the priming discharge line 32. Some provision to handle water overflowing from the reservoir will be necessary if the system is allowed to run, in this instance.

Suction valve 22 and discharge valve 26 may now be fully opened and priming discharge valve 34 and priming suction valve 30 may now be fully closed.

Thus, the pump assembly 10 has the ability to generate and sustain a vacuum in the suction line 14*b* during the priming process, equal to the maximum suction capability of the pump. This maximum suction is attained by controlling the flow of priming fluid in the pump and controlling the flow of air from the suction line to be mixed with the priming fluid so that it will pass freely through the impeller without substantially interfering with the normal operation of the pump.

Though less effective, another method to prime the pump would be to open the suction valve slightly, open the priming suction valve fully, flood the impeller and turn on the pump. In this instance, maximum suction has not been achieved. As air is drawn from the suction line and bubbles appear in the reservoir, the system will begin to prime. If high lifts are required beyond the adjustment of the priming suction valve and thereby the capacity of the current pump suction, bubbles will cease appearing in the reservoir. To resume priming, close the priming suction line slowly thereby increasing the vacuum toward the maximum suction capability of the pump and bubbles will reappear in the priming reservoir until the pump is fully primed and fluid begins to enter he priming reservoir.

A particular feature, of the pump 10, is the ability to deliver a sufficient controlled volume of priming fluid to the chamber to maximize the vacuum generated in the suction lines by the operation of the pump. In this case, the priming suction lines 18*a*, 18*b* are similar in diameter to the suction lines 14*a*, 14*b* so that a sufficient flow of priming fluid can be transferred into the pump so as to approximate the operational flow rate of the pump itself, so that, during priming, the priming suction valve can be adjusted to attain a maximum vacuum in the suction line 14*a* while still being isolated from the suction line 14*b*.

The priming suction lines can be larger than the suction lines, since they are used in conjunction with some form of flow control. However, the priming suction line should not be so small (such as for example, one half the diameter of the suction line or less), that the pump is simply not able to pull a sufficient quantity of water, to ultimately generate a maximum vacuum in the suction line.

Referring to FIGS. 2, 3 and 4, there is a similar pump assembly 110 which has both an impeller pump segment and an ejector pump segment and is a type of pump known as a 'convertible jet pump'. The configuration depicted in FIG. 2 can be referred to as a 'shallow well jet pump configuration'. For the sake of consistency, line components of the pump assembly 110 will be given the same two digit reference numerals as pump assembly 10. The pump assembly 110 has a pump chamber 112 and an ejector body 140 containing an ejector passage. The priming suction line 118*b* is in fluid communication with the pump chamber 112 adjacent to the ejector body by way of an extension means in the form of an extension member 142 that is mounted between the pump body 112 and the ejector body 140. The extension member is also provided with conduit means to receive the priming suction line in fluid communication therewith, in this case in the form of an aperture 144*a* to receive the priming suction line via priming suction valve 130.

The ejector body 140 includes a diffuser element 140*a*, a nozzle element 140*b* positioned in a suction line passage 140*d* and a recirculating passage 140*c* in fluid communication with the pressurized side of the impeller (not shown)

and the nozzle element 140*b*.The extension member 142 has a corresponding pair of passages 144*c*, 144*d*, each for fluid communication with a corresponding one of the recirculating and suction line passages of the ejector body 140. In this case, the aperture 144*a* is aligned with the suction line passage.

As seen in FIG. 3*a*, the extension member has an outer surface with a pair of depressions shown at 144*e* to fit between a corresponding pair of retaining fasteners in the form of lug bolts 145 extending between a pair of passages 140*e* in a mounting flange 140*f* on the ejector body 140 and passages 112*b* in the pump body 112. The extension member has a pair of opposing outer surfaces 144*f*, each of which is arranged to establish a sealing connection with a corresponding mating face on the pump body and the ejector body, that is with appropriate gasket materials as shown at 147 therebetween.

While the extension member 142 takes the form of a unitary member as shown above, it may instead be two or more conduit bearing members to serve the same function.

The impeller is located in the vacuum region and the ejector pump located in the ejector body, in which case the extension member is located between the two and has the effect of priming the impeller pump while the impeller pump has the function of operating the ejector pump. The ejector pump has a dual function, by providing the majority of the vacuum into the main suction line thereby to act as a booster to the impeller pump and the convertible jet pump as a whole.

Since some suction is generated by the ejector pump and the ejector pump is operated by fluid from the impeller in the pump chamber, a minimum fluid pressure of, say, 15 to 20 psi should be maintained to the ejector pump. This may simply be accomplished by closing the priming discharge valve slightly, if necessary, and observing a system pressure gauge (not shown) until 15 to 20 psi minimum is observed in the chamber.

The ejector pump also acts as a device for drawing air from the suction line to the impeller pump in a controlled manner.

In other words, by being controlled, the quantity of air being drawn into the vacuum region is below that which would overcome the flow of priming fluid from the priming suction line and cause air to collect at the impeller and stop the priming process. This control function is provided in earlier examples by the suction valve which controls the flow of air through the suction line and hence into the vacuum region. In some cases, leaving valve 122 only slightly open during priming with the extension member in place may assist the priming process.

The adjustment of the priming suction flow control valve to an optimum vacuum level will depend on a number of factors such as the size of, or flow restriction in, the suction and priming discharge lines, the vacuum generating capacity of the pump, the flow rate of the pump, and the pumping capacity of the pump. In many cases for the pump assembly 110, the priming suction valve 130 and the suction valve 122 may be opened fully for the priming process if the priming discharge line and the priming suction lines are both the same size as the pump discharge line 116.

Referring to FIG. 5, there is provided still another pump assembly 210. Again, for the sake of consistency, line components of the pump assembly 210 will be given the same two digit reference numerals as pump assembly 10. In this case, the priming suction line 218 is in direct fluid communication with the vacuum region of the pump body 212 by way of an aperture formed in the pump body itself and shown by dashed lines at 212*b* (and sized similar to the priming suction line), and the priming suction valve 230.

Referring to FIG. 6, there is provided still another pump assembly 310 that is arranged to automatically retain the primed condition in the pump assembly. Again, for the sake of consistency, line components of the pump assembly 310 will be given the same two digit reference numerals as pump assembly 110. In this case, the reservoir 328 is closed and the discharge line 316 flows directly into the reservoir 328 at its upper end 316*b* and exits the reservoir at is upper end. In this manner, at least a portion of the discharge line is downstream of the reservoir.

Meanwhile the priming suction line 318 leaves the reservoir 328 at its lower end. A vent means, in the form of an air bleed valve 350 is provided in an access opening 351 at the upper end of the reservoir. The valve is operable between a first position for venting or releasing air from the reservoir and a closed second position when said reservoir is filled with fluid. In this case, the vent releases air until such time as its flotation ball shown at 350*a* is raised and closes the valve under the buoyant force of water appearing at the valve's outlet 350*b*. The air bleed valve 350 is threaded into the reservoir 328 and, when removed, provides an access hole to fill the reservoir 328 with priming fluid for the first time. In this case, the extension member 342 controls the flow of fluid being drawn from the suction line, thereby avoiding the need to adjust the suction valve 322 during the priming process.

The pump assembly 310 is also equipped with a pressure switch 352 by way of pressure line 352*a* and an electrically operated solenoid valve 354 located in the priming suction line 318. In this case, the pressure switch as shown at 352 is set to operate at a lower pressure than the conventional pressure switch 353 on a conventional pressurized pump installation, for instance. In this case, the pressure switch 352 functions as a sensing means for sensing a low pressure condition in said chamber indicative of a loss of prime therein. The pump assembly 310 will operate if the system pressure drops to, say, 20 pounds per square inch ("psi") at switch 353 but the second switch 352 will not activate until the pressure drops to, say, 10 psi, or lower indicating a loss of prime. The reservoir will hold sufficient water below the access opening 351 to prime the system.

If the prime is lost for any reason, the pressure will drop as sensed by the pressure switch 352 from the pressure line 352*a*. Being responsive to the pressure switch, the solenoid valve 354 opens to permit the pump assembly to prime itself with water from the reservoir. The air in the suction and discharge lines will exit through the air bleed valve until water reaches the pump and fills the reservoir up to the floatation ball, thereby causing the bleed valve to close and allow the system to build pressure. When the pressure builds up, the solenoid valve will close and the pump will continue to pump fresh water and eventually shut off when the normal operating system pressure has been reached.

It will be understood that the reservoir is schematically shown in FIG. 6 and may not represent the actual volume thereof in relation to the suction and discharge lines. The reservoir may, for example be in the order of several gallons or as little as a few gallons depending on the amount of priming fluid needed to recirculate through the pump assembly. This applies also to the reservoirs shown in the other embodiments herein.

The pump assemblies shown hereinabove can be made available in a number of different arrangements, for example by stand alone pumps with their priming capabilities built-in as described for example by FIG. 5, by kits which can be used to retrofit a conventional pump to have the priming capacity as mentioned herein, or simply by a sheet of instructions enabling a pump owner to acquire the extra valves, hoses, gauges and reservoir to retrofit his pump to work as described herein. Thus, the present technique is applicable for conventional pumps already in use.

The devices and techniques described hereinabove enable the pump to generate vacuum in the suction line substantially equal to the maximum suction capability of the pump, that is by drawing in a controlled manner, one or both of the priming fluid from the reservoir and the fluid (be it water or air) from the suction line. Moreover, the priming operation can be easily monitored during the priming process by observing the bubbles in the reservoir and adjusting the system in the unlikely event that the priming process stops.

While the pump assemblies illustrated above utilize a priming discharge line in fluid communication with the pump chamber, there may be some applications where the priming discharge line may not be needed. For example, the reservoir may be sufficiently large to contain enough priming fluids to complete the priming process without the need for being replenished, as is being done by the priming discharge line. Moreover, there may be some cases where the reservoir can be replenished simply by refilling the reservoir manually, thereby again not necessarily requiring the priming discharge line.

Also provided herein is a kit for priming a pump of a type having a chamber with a vacuum region, a suction line in fluid communication between the vacuum region and a fluid source, and a discharge line in fluid communication with the chamber, comprising:

a suction valve;

a length of pipe operable as a priming suction line, a priming suction valve for fluid communication with the priming suction line, and a sheet of instructions, including the steps of:

i. installing the suction valve in the suction line to control fluid from a fluid source therethrough;

ii. installing the priming suction line so as to be in fluid communication with the vacuum region;

iii. installing one end of the priming suction valve in the priming suction line to control priming fluid flow therethrough; and iv. installing another end of the priming suction line in a priming fluid reservoir.

Of course, if desired, the kit may also include a vacuum gauge, length of pipe operable as a priming discharge line and a priming discharge valve as above described. In this case, the instructions would include steps to install the priming discharge line and valve.

The kit may, for example, include one extension member as shown at 142 as shown in FIG. 4, with the associated gaskets, lug bolts, valve, threaded coupling pipes (commonly referred to as nipples), hose fittings and the like, again with a set of instructions for preparing the pump assembly as shown and for priming the pump assembly as discussed hereinabove.

Thus, the pump assemblies as described above have the ability to automatically draw air and water up the suction line, entirely by the vacuum developed in the vacuum region.

Referring to FIG. 7, there is provided still another pump assembly 410. Again, for the sake of consistency, line components of the pump assembly 410 will be given the same two digit reference numerals as pump assembly 10. The pump has a pump body 412 containing the vacuum region, a suction line 414*a*, 414*b*, first priming suction lines 418*a*, 418*b* and a discharge line 416. Also provided is a valve 422 in the suction line which is operable in a priming position to isolate the vacuum chamber from said suction line and in a second pumping position to establish fluid communication therebetween. In this case, the priming suction lines are arranged to deliver sufficient priming fluid to the vacuum chamber when the valve means is in the first priming position, to establish a primed condition in the pump.

The priming discharge line 432 has an ejector unit 460 installed therein to enhance the priming sequence. The ejector unit has an inlet 460*a* with a nozzle section 460*b* leading into a diffuser section 460*d*. Located immediately downstream of the nozzle section 460*b* is an aperture 460*c* to receive a return suction line 461 which is in fluid communication with suction line 414*b* at a second junction 462 upstream of the suction valve 422 and associated priming suction valve 463. The ejector unit also has an outlet shown at 460*e* which is joined to the priming discharge line 432.

The pump assembly is operated by filling the vacuum region of the pump 412 with priming fluid using the procedures described for pump assembly 10. Valves 422 and 426 are closed and valves 430, 434 and 463 are opened. The pump is turned on and fluid circulates from the reservoir through lines 418, 414 to the vacuum region of the pump. The fluids pass through the discharge line 416, through the ejector pump 460, and back to the reservoir. The priming of the pump 412, from the reservoir 428, now has the effect of operating the ejector pump 460, as in pump assembly 110, creating suction in the return suction line 461. As fluid passes through the nozzle 460*b* and enters the diffuser 460*d*, a relatively high vacuum is generated at 460*c*,drawing air and fluid up suction lines 414*b* and 461. When the fluid reaches the reservoir, the valve 422 is then opened and the valve 463 is closed to complete the priming process.

Thus, pump assembly 410 makes use of a suction means in fluid communication with the discharge line and the suction line for establishing a vacuum therein solely as a result of priming fluid passing through the discharge line. In other words, the ejector unit has the effect of drawing the air and water up the suction line using the flow of the recirculating priming fluids, that is by using a recirculating priming fluid reservoir 428 to prime pump 412, and pump 412 to operate ejector unit 460, to create a vacuum and remove air from suction line 414*b*, and vent it to the atmosphere, using no external source of fluid or compressed air to operate ejector pump 460 during the entire priming process and thereby form a self-priming pump assembly 410.

In this particular case, the kit may, for example, include a number of 'Tee' fittings, nipples, valves, hose fittings, along with the ejector unit and the like, again with a set of instructions for preparing the pump assembly as shown in FIG. 7 and for priming the pump assembly as discussed hereinabove.

While the pump assembly makes use of a suction means in the form of the ejector unit shown, there may be other ways of imparting a vacuum in the suction line as a result of fluid flow through the discharge line, solely or otherwise, by way of other nozzle arrangements, water wheels and the like.

I claim:

1. A method of priming a pump assembly, comprising the steps of:

providing a pump with a vacuum region therein, providing a suction line in fluid communication between said vacuum region and a fluid source;

providing a priming suction line in fluid communication between said vacuum region and a priming fluid reservoir, in order to deliver priming fluids to said vacuum region so as to establish a primed condition in said pump;

restricting flows through said suction line and said priming suction line respectively, in order to establish a vacuum in said vacuum region, so as to substantially fill said suction line with fluid from said source, while maintaining said primed condition; and varying said vacuum according to the elevation of said pump relative to said fluid source, up to a maximum suction capacity of said pump.

2. A pump assembly, comprising:

a pump with a chamber having a vacuum region therein, a priming fluid reservoir above said vacuum region, a suction line for fluid communication between said vacuum region and a fluid source, and a priming suction line for fluid communication between said vacuum region and said priming fluid reservoir, in order to deliver priming fluids to said vacuum region so as to establish a primed condition in said pump;

suction flow control means in said suction line and priming flow control means in said priming suction line;

said flow control means being operable to restrict flow through said suction line and said priming suction line, in order to establish a vacuum in said vacuum region to substantially fill said suction line with fluid from said source while maintaining said primed condition, wherein said vacuum is variable up to a maximum suction capacity of said pump.

3. An assembly as defined in claim 2 further comprising a discharge line in fluid communication with said chamber and discharge flow control means for controlling flow through said discharge line.

4. An assembly as defined in claim 3 further comprising a priming discharge line between said chamber and said priming fluid reservoir for delivering priming fluid from said chamber to said priming fluid reservoir.

5. An assembly as defined in claim 2 wherein said suction flow control means includes a suction valve positioned in said suction line and said priming suction line is in fluid communication with said suction line downstream of said suction valve.

6. A pump assembly, comprising:

a pump with a chamber having a vacuum region therein, a priming fluid reservoir above said vacuum region, a suction line for fluid communication between said vacuum region and a fluid source, and a priming suction line for fluid communication between said vacuum region and said priming fluid reservoir, in order to deliver priming fluids to said vacuum region so as to establish a primed condition in said pump;

suction flow control means in said suction line and priming flow control means in said priming suction line;

said flow control means being operable to restrict flow through said suction line and said priming suction line, in order to establish a vacuum in said vacuum region to substantially fill said suction line with fluid from said source while maintaining said primed condition, wherein said vacuum is variable up to a maximum suction capacity of said pump, wherein said suction flow control means includes a suction valve positioned in said suction line and said priming suction line is in fluid communication with said suction line downstream of said suction valve, wherein said pump further comprises an ejector body, said priming suction line being in fluid communication with said vacuum region adjacent said ejector body.

7. An assembly as defined in claim 6 further comprising a discharge line in fluid communication with said chamber and discharge flow control means for controlling flow through said discharge line.

8. An assembly as defined in claim 7, wherein said ejector body contains an ejector pump, said assembly further comprising a priming discharge line between said chamber and said priming fluid reservoir for delivering priming fluid from said chamber to said priming fluid reservoir, and priming discharge flow control means for controlling flow through said priming discharge line to provide sufficient pressure to operate said ejector pump.

9. An assembly as defined in claim 8 further comprising extension means mounted between said chamber and said ejector body, said extension means further comprising conduit means to receive said priming suction line in fluid communication with said extension means.

10. An assembly as defined in claim 9 wherein said extension means includes an extension member, said ejector body includes a suction line passage in fluid communication with a recirculating passage, said extension member including a pair of passages, each for fluid communication with a corresponding one of said recirculating and suction line passages, said conduit means being aligned with said suction line passage.

11. An assembly as defined in claim 10 wherein said reservoir is closed, said assembly further comprising a discharge line, at least a portion of said discharge line being downstream of said reservoir.

12. An assembly as defined in claim 11 further comprising sensing means for sensing a low pressure condition in said reservoir indicative of a loss of prime in said reservoir, said priming flow control means being responsive to said sensing means.

13. An assembly as defined in claim 12 wherein said reservoir further comprises venting means operable in a first position for venting air from said reservoir and a closed second position when said reservoir is filled with fluid.

14. A pump assembly, comprising:

a pump with a chamber having a vacuum region therein;

a priming fluid reservoir;

a suction line for fluid communication between said vacuum region and a fluid source;

a priming suction line for fluid communication between said vacuum region and said priming fluid reservoir;

a discharge line in fluid communication with said chamber; and flow control means operable in a first priming position to isolate said vacuum chamber from said suction line, said priming suction line being arranged to deliver sufficient priming fluid to said vacuum chamber when said flow control means is in said first priming position, to establish a primed condition in said pump; and suction means in fluid communication with said discharge line and said suction line and operable when said flow control means is in said priming position to establish a vacuum in said suction line as a result of priming fluid passing through said discharge line.

15. An assembly as defined in claim 14 wherein said suction means further comprises a nozzle section in fluid communication with said discharge line, and a second priming suction line in fluid communication with said suction line upstream of said flow control means and, said suction means downstream of said nozzle section, so as to impart a vacuum in said second priming suction line.

16. An assembly as defined in claim 15 wherein said suction means further includes a diffuser section downstream of said nozzle section, said second priming suction line in fluid communication with said nozzle section and said diffuser section.

17. A pump assembly, comprising:

a pump with a chamber having a vacuum region therein, a priming fluid reservoir above said vacuum region, a suction line for fluid communication between said vacuum region and a fluid source, and a priming suction line for fluid communication between said vacuum region and said priming fluid reservoir, in order to deliver priming fluids to said vacuum region so as to establish a primed condition in said pump;

suction flow control means in said suction line and operable to restrict flow through said suction line, said priming suction line being arranged to deliver a controlled volume of priming fluid to said chamber to maximize the vacuum generated in said suction line, said assembly being operable to establish a vacuum in said vacuum region to substantially fill said suction line with fluid from said source while maintaining said primed condition.

18. An assembly as defined in claim 17 wherein said chamber has a priming suction port having a diameter which is substantially equal to the diameter of said priming suction line, further comprising a discharge line in fluid communication with said chamber and discharge flow control means for controlling flow through said discharge line, and a priming discharge line between said chamber and said priming fluid reservoir for delivering priming fluid from said chamber to said priming fluid reservoir.

19. An assembly as defined in claim 18 wherein said pump further comprises an ejector body, said priming suction line being in fluid communication with said vacuum region adjacent said ejector body.

20. An assembly as defined in claim 19 further comprising extension means mounted between said chamber and said ejector body, said extension means further comprising conduit means to receive said priming suction line in fluid communication with said extension means, said ejector body includes a suction line passage and a recirculating passage in fluid communication with said suction line passage, said extension means including a pair of passages, each for fluid communication with a corresponding one of said recirculating and suction line passages, said conduit means being aligned with said suction line passage.

* * * * *